US005971662A

United States Patent [19]

Becker et al.

[11] Patent Number: 5,971,662

[45] **Date of Patent: *Oct. 26, 1999**

[54] TRENCH DRAIN

[75] Inventors: Allen R. Becker; Michael A. Funari; Donald A. Kubiak, all of Erie, Pa.

[73] Assignee: Zurn Industries, Inc., Erie, Pa.

[ * ] Notice: This patent is subject to a terminal disclaimer.

[21] Appl. No.: 08/850,596

[22] Filed: May 2, 1997

Related U.S. Application Data

[63] Continuation-in-part of application No. 08/581,723, Dec. 29, 1995, Pat. No. 5,718,537

[60] Provisional application No. 60/017,021, May 3, 1996.

[51] Int. Cl.[6] ..... E02B 7/02

[52] U.S. Cl. ..... 405/119; 404/2; 405/121

[58] Field of Search ..... 405/118–123; 404/2, 4; 285/412; 24/543

[56] References Cited

U.S. PATENT DOCUMENTS

| | | | |
|---|---|---|---|
| 935,412 | 9/1909 | Rust | 405/412 |
| 1,008,466 | 11/1911 | Hess | 405/123 |
| 1,223,240 | 4/1917 | Becker . | |
| 1,699,948 | 1/1929 | Biedermann | 405/119 X |
| 2,194,717 | 3/1940 | Older . | |
| 3,225,545 | 12/1965 | Flegel . | |
| 3,788,756 | 1/1974 | Ito | 404/4 |
| 3,876,322 | 4/1975 | Deason . | |
| 4,490,067 | 12/1984 | Dahowski . | |
| 4,498,807 | 2/1985 | Kirkpatrick et al. . | |
| 4,640,643 | 2/1987 | Williams . | |
| 4,787,773 | 11/1988 | Kehler . | |
| 4,815,888 | 3/1989 | Stegmeier . | |
| 4,838,727 | 6/1989 | Capuano . | |
| 4,878,782 | 11/1989 | Beatie et al. . | |
| 4,940,359 | 7/1990 | Van Duyn et al. | 404/2 X |
| 4,993,877 | 2/1991 | Beamer . | |
| 4,993,878 | 2/1991 | Beamer . | |
| 5,000,621 | 3/1991 | Beamer . | |
| 5,026,202 | 6/1991 | Thomann . | |
| 5,066,165 | 11/1991 | Wofford et al. . | |
| 5,109,576 | 5/1992 | Teekell et al. | 24/543 |
| 5,226,748 | 7/1993 | Bärenwald et al. . | |
| 5,230,489 | 7/1993 | White et al. | 24/543 X |
| 5,256,000 | 10/1993 | Beamer . | |
| 5,281,052 | 1/1994 | Beamer . | |
| 5,326,189 | 7/1994 | Beamer . | |
| 5,326,190 | 7/1994 | Beamer . | |
| 5,399,047 | 3/1995 | Stegall . | |
| 5,501,547 | 3/1996 | Mantelli | 405/119 X |

*Primary Examiner*—Dennis L. Taylor
*Attorney, Agent, or Firm*—Webb Ziesenheim Logsdon Orkin & Hanson, P.C.

[57] ABSTRACT

A polymeric trench drain for use in a trench drain system. The trench drain includes an open-faced channel having a crushing rib. The crushing rib prevents buckling of the trench drain due to changes in temperatures. The trench drain also includes removable spacer blocks for use during installation, which prevent the trench drain channel from deforming during installation. Rebar clips and securement clips are provided for easy installation. A unique profile is provided on support ribs to assist in easy stacking of the trench drains prior to installation.

18 Claims, 13 Drawing Sheets

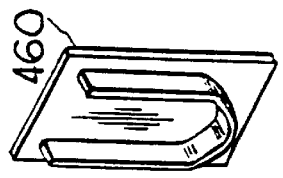
FIG. 16B
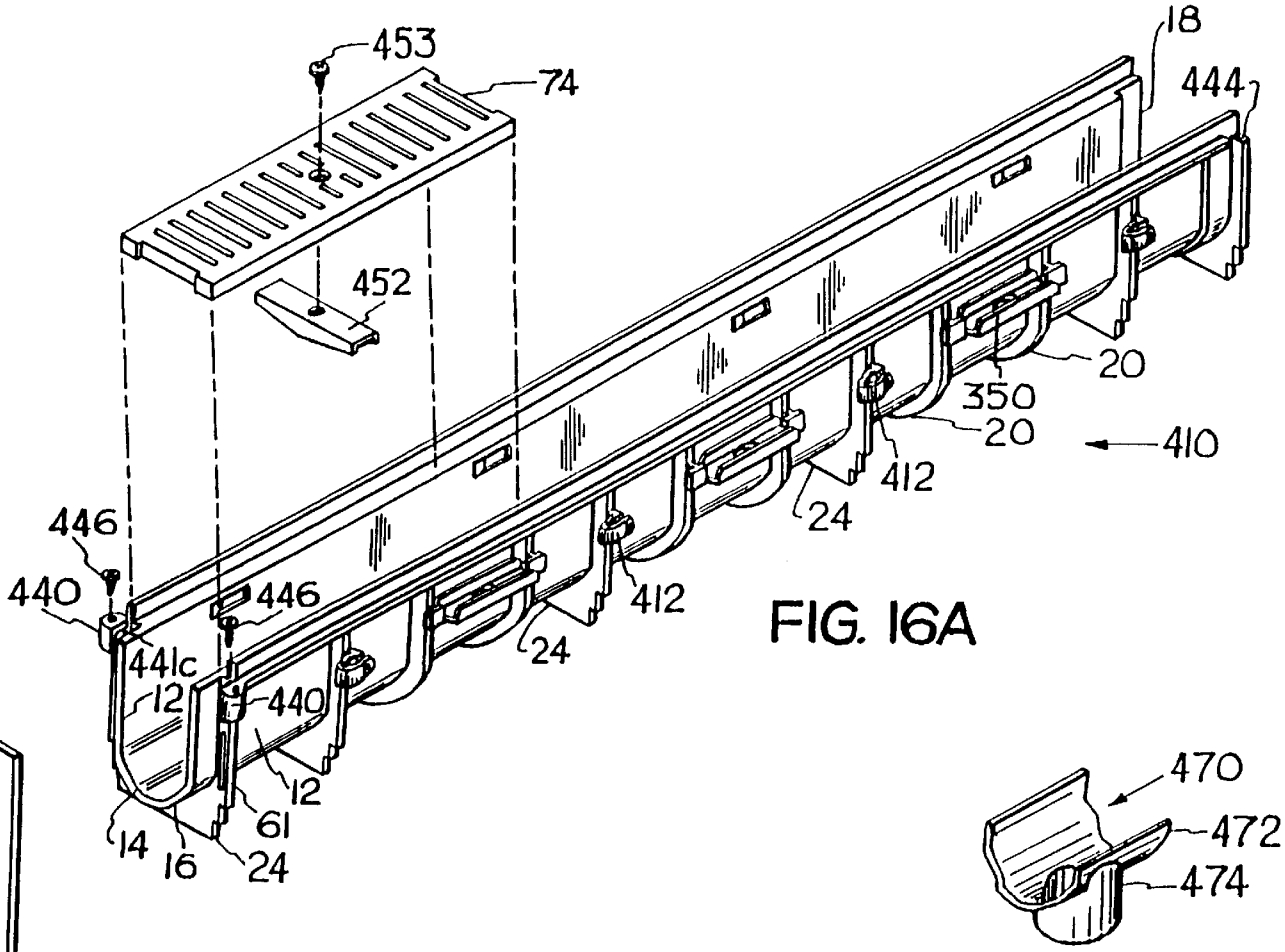
FIG. 16A
FIG. 16D
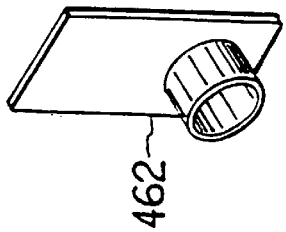
FIG. 16C

TRENCH DRAIN

CROSS REFERENCE TO RELATED APPLICATION

This application is a continuation-in-part of U.S. application Ser. No. 08/581,723, filed Dec. 29, 1995 now U.S. Pat. No. 5,718,537 and claims the benefit of U.S. Provisional Application Ser. No. 60/017,021, filed May 3, 1996.

BACKGROUND OF THE INVENTION

1) Field of the Invention

This invention relates generally to the field of trench drains, and more particularly, to a modular trench drain system.

2) Description of the Prior Art

The general concept of trench drains is well-known in the prior art. Trench drains are used where extensive amounts of liquid must be moved from one place to another. The trench drains typically transport the liquid to a drainage sewer. Typically, trench drains are U-shaped or V-shaped troughs and are installed adjacent to either roadways or buildings. They are installed in the ground and secured in concrete. In many cases, the trench drains include a grate to prevent large debris and people from falling into them.

Trench drain systems include several basic designs: concrete, metal and plastic. Generally, concrete trench drain systems use forms. The forms are placed in a ditch dug in the ground. Concrete is then poured around the forms, which are removed after the concrete has set, see for example, U.S. Pat. No. 4,993,878. Trench drain systems made in accordance with this method or similar methods result in relatively expensive systems due to the cost of installing and removing the forms.

U.S. Pat. No. 3,225,545 discloses a metal trench drain for use in a trench drain system. This type of trench drain results in high costs due to transportation, manufacture and installation. Also, precast concrete trench drains result in similar costs for a trench drain system.

Many of the expenses associated with these prior art trench drain systems have been overcome by the advent of polymeric trench drains, which can be left in place after the concrete has been poured in place, see U.S. Pat. No. 5,066,165. These trench drains perform two functions. First, they act as a form for the concrete; and second, they act as a liner. The manufacture and transportation costs with this type of trench drain are significantly less than the other types of trench drains.

However, trench drain systems made of polymeric trench drains have problems not associated with the other types of trench drain systems, namely buckling due to the expansion of the trench drains. This typically occurs when the trench drains are installed in colder weather. They then expand in hotter weather due to the polymeric materials' high coefficient of expansion. The embedding concrete prevents the trench drains from expanding in a longitudinal direction. Therefore, the trench drains buckle to compensate for this expansion. Further, the trench drains can deform during installation when wet concrete is poured around the periphery of the trench drains. This is due to the pressure of wet concrete against the trench drain walls.

Furthermore, as in all of the above trench drain systems, installing the polymeric trench drains require a substantial amount of hardware, i.e., nuts and bolts, which adds not only to the cost, but can also result in delays, should the installer run out of this hardware.

Therefore, it is an object of our invention to provide a polymeric trench drain which will not buckle due to temperature variations.

It is also an object of our invention to provide a trench drain system that is easy to install and transport.

It is also an object of our invention to provide a trench drain that will not deform during installation due to the pressure of wet concrete poured about the periphery of the trench drain.

It is yet another object of our invention to minimize the amount of extraneous hardware required to install the trench drains.

SUMMARY OF THE INVENTION

Our invention is a trench drain that includes an open-faced channel having spaced apart sidewalls connected to a bottom wall, where the channel includes a first end and a second end. The trench drain includes a crushing section attached to the channel, which is adapted to crush when a compressive force is applied to the channel in a longitudinal direction so as to eliminate buckling of the channel.

A clip is provided to an outer surface of one of the sidewalls for frictionally engaging with a support rod used to support the channel. The clip can be a two-piece clip.

Preferably, the first end of the trench drain includes a male section and the second end of the trench drain includes a female section adapted to matingly receive a respective male section of an adjacent trench drain. Fasteners, securement clips or connection members can be provided to secure adjacent trench drains together.

Preferably, a plurality of ribs are provided that extend from the channel, where a stacking profile is defined by a lower portion of the ribs. The stacking profile is adapted to matingly engage with a surface of another trench drain channel to permit stacking of the trench drain prior to installation.

Spacer blocks can be secured to the channel through frangible sections. The spacer blocks are then removed from the channel by breaking the frangible sections. The spacer blocks are also adapted to coact with inner surfaces of the sidewalls to prevent the sidewalls from moving toward each other.

Also, our invention is a method for forming a trench drain system having a plurality of trench drains, where each trench drain includes a spacer block connected by a frangible member to the trench drain channel. The method includes the steps of: forming an area for receiving a trench system; placing a trench drain in the area; placing a second trench drain in the area; attaching the first and second trench drains to each other; breaking the frangible members and removing the spacer blocks from the trench drains; engaging the blocks with the interior of the channels; pouring concrete around the trench drains; and removing the spacer blocks from the channels.

Another aspect of our invention is a trench drain that includes an open-faced channel and a clip. The open-faced channel includes spaced apart sidewalls connected to a bottom wall, the channel having a first end and a second end. The clip attaches to an outer surface of one of the sidewalls. The clip includes a two-piece body defined by a first section and a second section. The first section includes a tip having a fastener receiving portion, which can be a screw hole, and the second section includes a fastener engaging surface. The first section is hinged to an end of the second section. The second section is secured to the channel. The first section is adapted to move relative to the second section so that the fastener receiving portion can align with the fastener engaging surface for a fastener (such as a screw) to pass through the tip and the fastener engaging surface to form a closed structure defining a support rod engagement surface for engaging with a support rod to support the channel.

Yet another aspect of the invention is a trench drain that includes an open-faced channel and a connection member secured to the channel. The open-faced channel includes spaced apart sidewalls connected to a bottom wall. The channel includes a first end and a second end. The connection member includes a body that defines a recess adapted to receive therein an engagement member of an adjacent trench drain in the recess. The trench drain can further include an engagement member secured to the channel adapted to be received by a connection member of an adjacent trench drain wherein the engagement member is a rib extending from the channel. Fasteners, such as screws, can be used to secure the connection member to the engagement member of an adjacent trench drain. The channel extends along a longitudinal axis, and the connection member body includes a sidewall and an upper wall that define the connection member recess. The connection member body defines a side opening and a bottom opening for receipt of the engagement member defined by a portion of a laterally extending rib of the adjacent trench drain into the recess.

BRIEF DESCRIPTION OF THE DRAWINGS

FIG. 16A is a top perspective view of a fifth embodiment of a trench drain made in accordance with the present invention;

FIG. 16B is a top perspective view of a closed end plate used with a trench drain;

FIG. 16C is a top perspective view of an outlet end plate used with a trench drain;

FIG. 16D is a top perspective view of an outlet attachment used with a trench drain;

DESCRIPTION OF THE PREFERRED EMBODIMENTS

Figures 1, 2, 3:
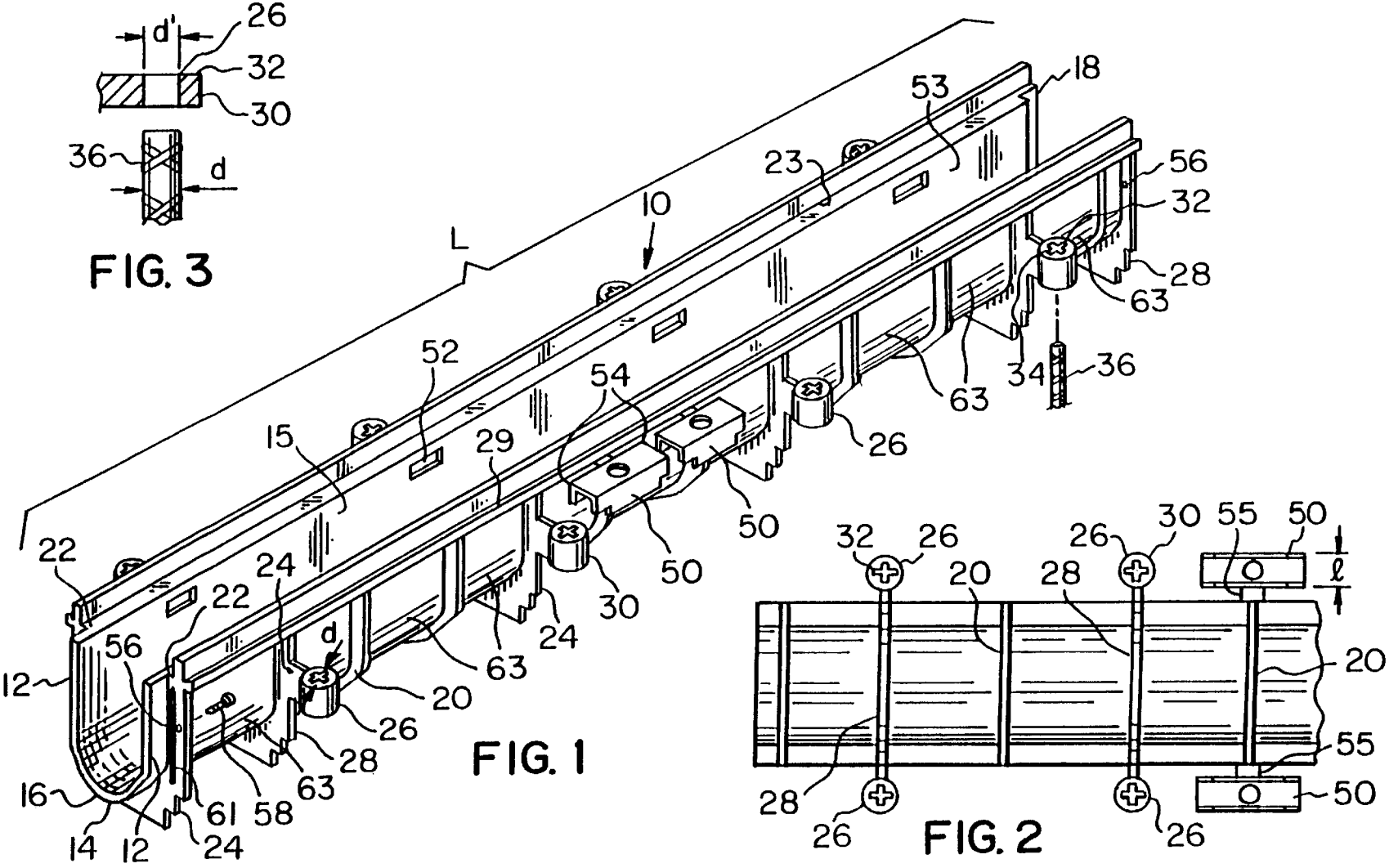
FIG. 1 is a top perspective view of a trench drain made in accordance with the present invention.
FIG. 2 is a bottom plan view of a portion of the trench drain shown in FIG. 1.
FIG. 3 is a partial sectional side view of a rebar clip of the trench drain.

FIGS. 1 and 2 show a V-shaped trench drain 10 made in accordance with the present invention. The trench drain 10 includes spaced apart sidewalls 12 connected to a V-shaped bottom wall 14 and define an open-faced channel 15. Sidewalls 12 can either be straight or angled. Likewise, bottom wall 14 can either be flat or angled so that water or other liquids can be directed from one end to another.

Figure 10:
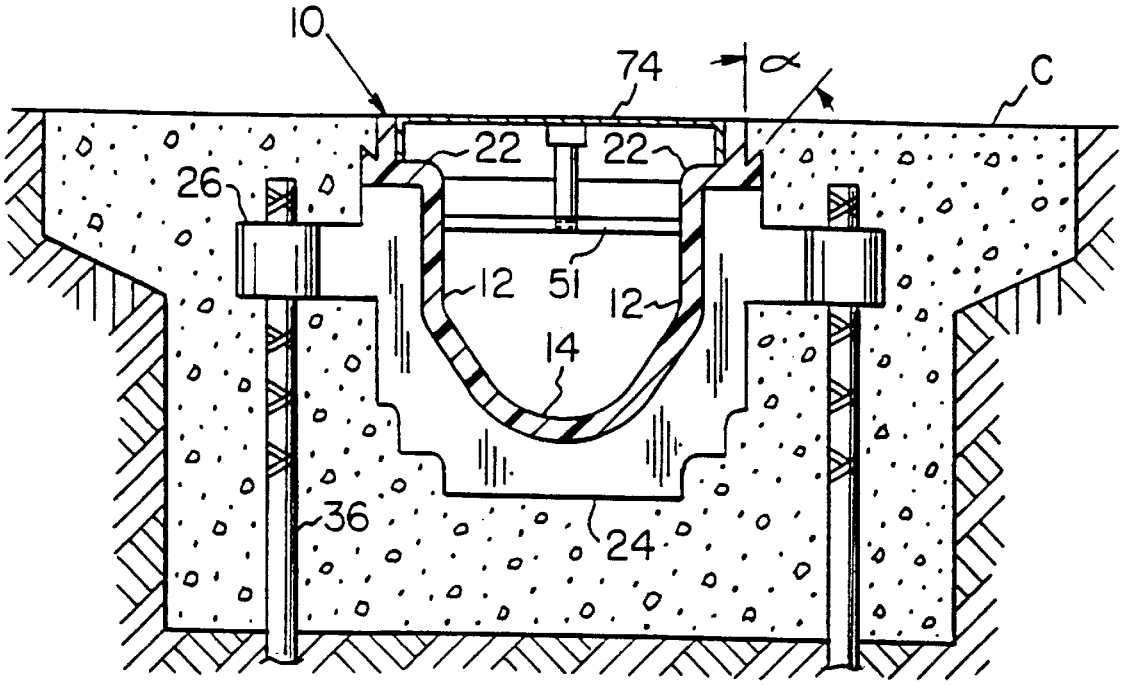
FIG. 10 shows a section taken along lines X—X of FIG. 9.

The trench drain 10 includes a first end or male end 16 and a second end or female end 18. The male end 16 includes a portion of the walls 12 and 14 and the female end 18 defines a recessed portion adapted to matingly receive a male end 16 of an adjacent trench drain. A plurality of ribs 20 are integrally formed in the walls 12 and 14 and are spaced along the length of the trench drain 10. The ribs 20 add structural strength to the trench drain 10. A plurality of support ribs 24 are also integrally formed in the walls 12 and 14 and are spaced along the length of the trench drain 10. Support ribs 24 include a lower section 28 defining a stacking profile. An L-shaped lip 22 is defined at upper ends of respective sidewalls 12. Lips 22 define recesses 23 for receiving a grate. Seepage lips 29 extend along outer surfaces of sidewalls 12 near the upper ends of the sidewalls 12. An upper surface of each seepage lip 29 is angled an angle a (approximately 45°) as shown in FIG. 10.

Rebar clips 26 are integrally formed on opposite sides of many of the support ribs 24, and are positioned adjacent an outer surface of the sidewall 12. As shown in FIGS. 1–3, each rebar clip 26 includes a rebar clip body 30 having a rebar clip engagement surface 32. The rebar clip engagement surface 32 defines an annular hole 34 passing therethrough. As shown in FIG. 3, the rebar clip hole 34 has a diameter "d'" that is less than the diameter "d" of the supporting rebar 36. The supporting rebar 36 is used to support the trench drain 10 in a trench as will be explained below.

Figure 9:
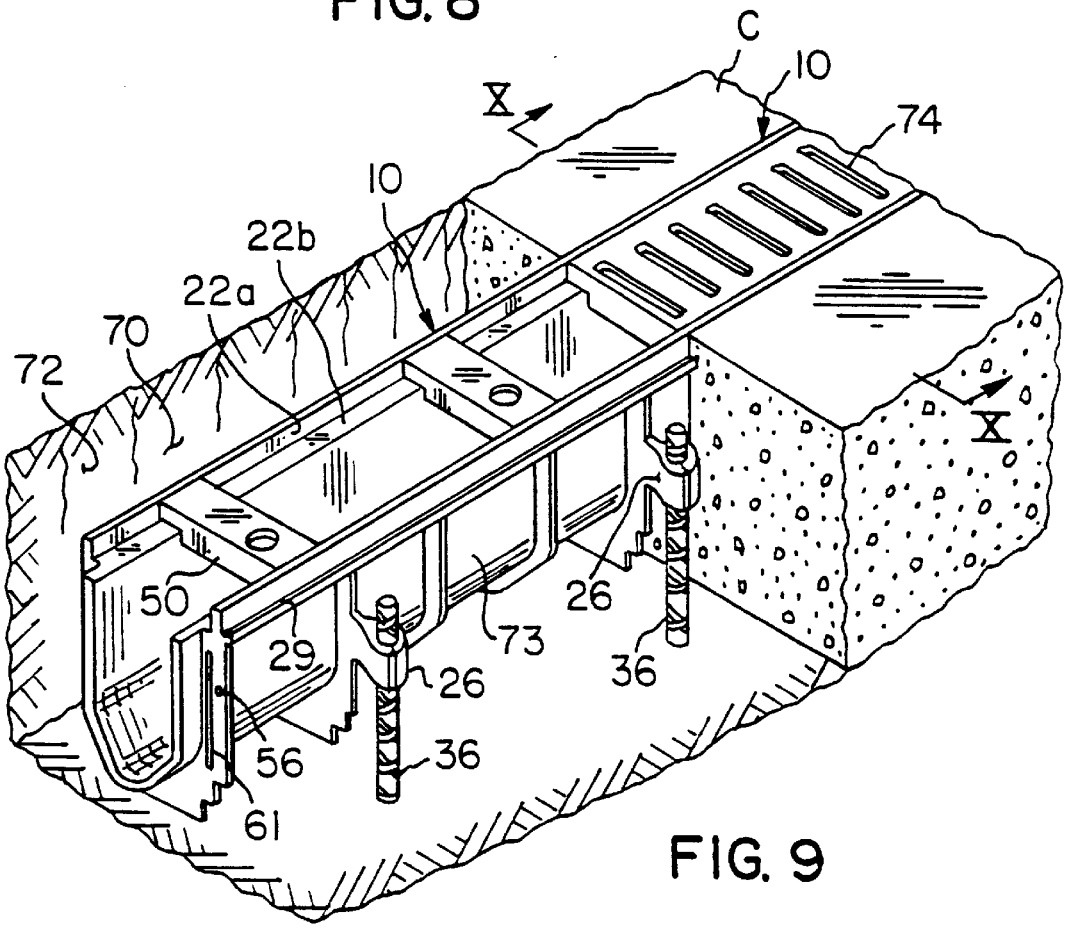
FIG. 9 is a top perspective view of the trench drain shown in FIG. 4 that is partially installed in a trench.

Referring back to FIGS. 1 and 2, a plurality (four) of U-shaped spacer blocks 50 are integrally secured to outer surfaces of sidewalls 12. Any number of spacer blocks can be provided such as one, two or twelve, for example. The spacer blocks 50 are adapted to be received between lips 22 as shown in FIG. 9. Recesses 52 are spaced directly apart from each other on opposite sidewalls 12 for receipt of steel cross members 51 adapted to receive a bolt for securing a grate to the trench drain 10. Four sets of recesses are defined per trench drain 10.

Figure 4:
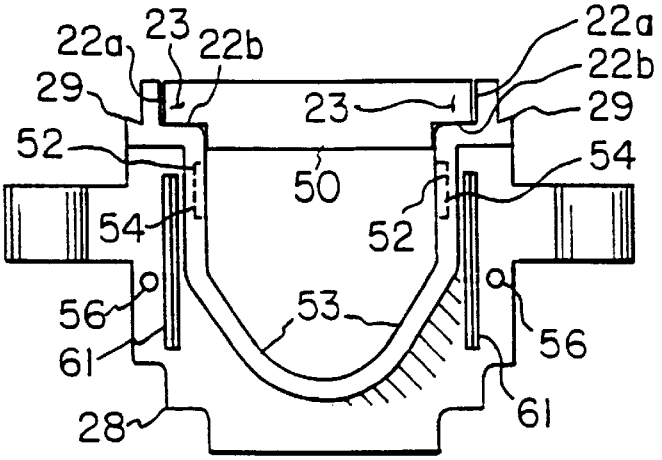
FIG. 4 is a front elevational view of the trench drain having an installed spacer block made in accordance with the present invention.

Each spacer block 50 is U-shaped and has a base portion with two legs depending therefrom. Each end 54 has a length "l" and width "w" dimensions adapted to be received by a lip 22 such that the ends 54 can be removably received by the lips 22. A frangible section 55 secures each spacer block 50 to the respective sidewall 12. The frangible section 55 will break when a breaking force is applied to the spacer block 50 by an installer so that the spacer block can be removed from the trench drain 10. As shown in FIG. 4, the removed spacer blocks' ends 54 are adapted to be placed onto the lips 22.

Referring to FIGS. 1 and 4, screw holes 56 are defined within the support ribs 24 adjacent the male end 16 and female end 18. Screws 58 are adapted to pass through these respective holes during assembly so as to fasten adjacent male and female ends 16 and 18 of respective trench drains 10.

Figure 6B:
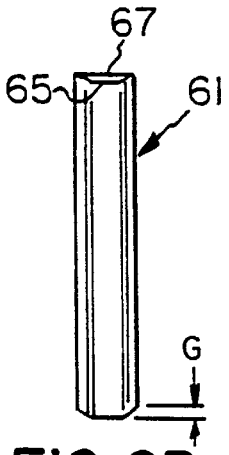
FIG. 6B is a top perspective view of the crushed crushing rib shown in FIG. 6A.
Figure 5A:
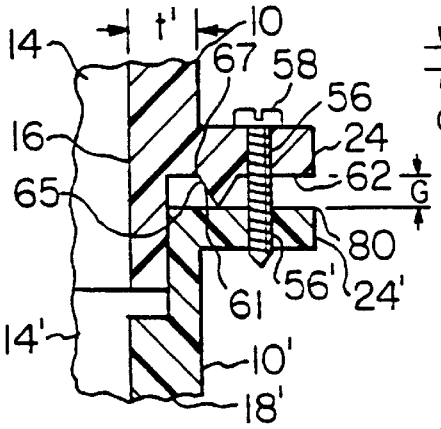
FIG. 5A is a partial top sectional view of portions of the two adjacent trench drains made in accordance with the present invention, showing an uncrushed crushing rib.
Figure 5B:
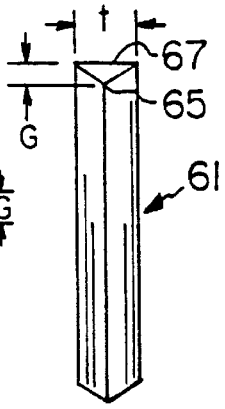
FIG. 5B is a top perspective view of the uncrushed crushing rib shown in FIG. 5A.
Figure 6A:
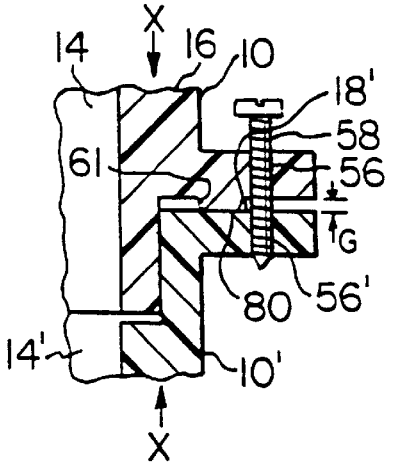
FIG. 6A is a partial top sectional view similar to that of FIG. 5A, showing a crushed crushing rib.
Figure 7:
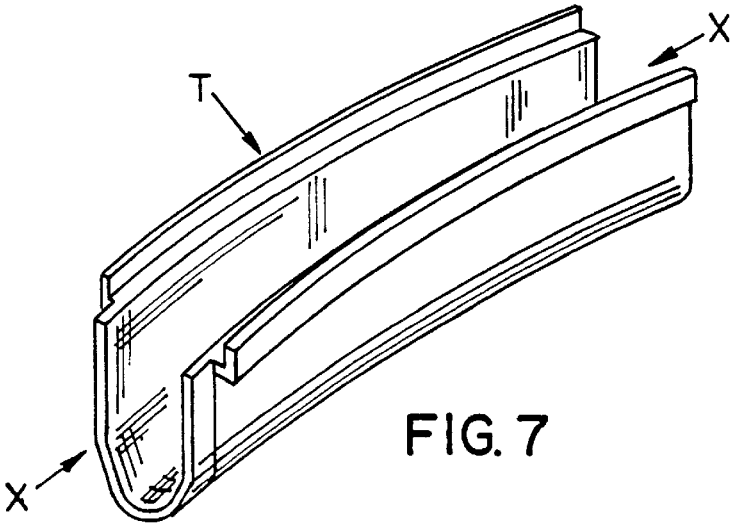
FIG. 7 is a top perspective view of a buckled trench drain.

A plurality of trench drain panel portions 63 are defined between ribs 20 and 24. The trench drain panel portions 63 include contiguous sections of walls 12 and 14. The trench drain also includes a crushing rib or section 61 attached to the channel 15. The crushing rib 61 is defined on a face 62 of the support rib 24 adjacent the sidewalls 12 of the male end 16. As can be seen from FIGS. 5A and 5B, prior to crushing, the crushing rib has a triangular cross section with an apex portion 65 and a base portion 67. The thickness "t" of the base portion 67 is preferably approximately 3/32 inches or one quarter of the thickness "t'" of the trench drain panel portions 63. Referring now to FIGS. 6A and 6B, in this arrangement crushing rib 61 will crush when a compressive force is applied to the trench drain 10 in a longitudinal direction "X" prior to the buckling of a trench drain "T" as shown in FIG. 7.

Preferably, trench drain 10 is made of a polymeric or plastic material, such as a resin containing fiberglass, nylon, or a polyethylene and formed in lengths eighty inches. Trench drain 10 weighs considerably less than a comparable concrete or metal trench drain. In general, more polymeric trench drains can be transported per truckload than concrete or metal trench drains because of their light weight.

Figure 8:
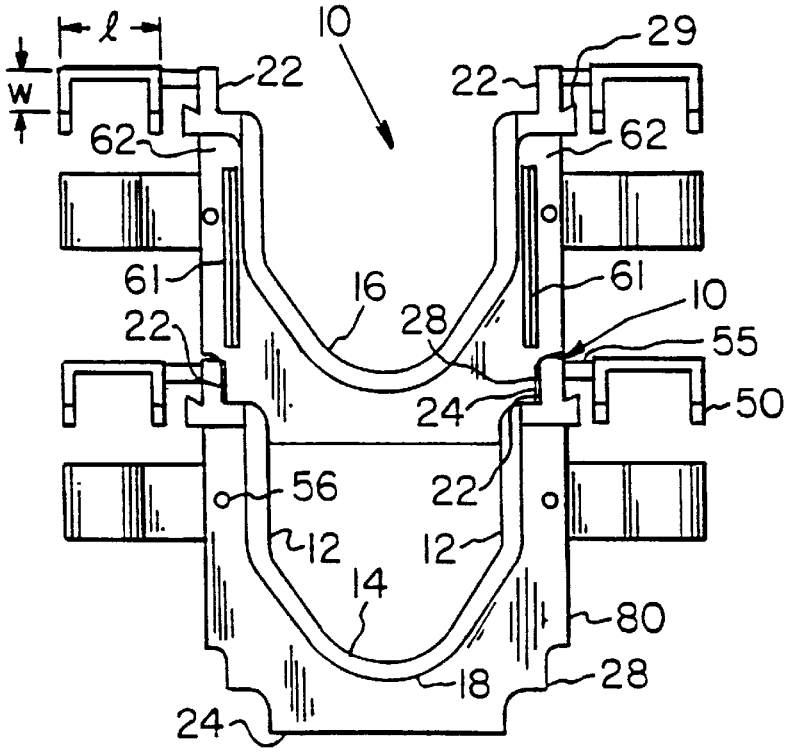
FIG. 8 is a front elevational view of two stacked trench drains made in accordance with the present invention.

Other polymeric trench drains, such as that disclosed in U.S. Pat. No. 5,066,165, have problems as far as being able to stack a plurality of these trenches in a row. As shown in FIG. 8, support ribs 24 overcome this problem. Each support rib lower section 28 includes the stacking profile. As can be seen in FIGS. 1, 2 and 8, each side of support rib lower section 28 includes a stepped portion which corresponds to a profile of an outer surface of a respective lip 22. As specifically shown in FIG. 8, the sides of support rib lower section 28 matingly engage with respective portions of lips 22 of an adjacent trench drain 10, when two or more trench drains are stacked on top of each other for transporting or storage. The trench drains 10 can then be easily unstacked.

Referring to FIGS. 9 and 10, the installation of the trench drain system will be discussed. First, a trench 70 is dug in the ground 72 defining an area for receiving a plurality of trench drains. Then, a plurality of trench drains 10 are positioned adjacent to each other. A plurality of spaced rebar support rods 36 are secured to the ground 72 and positioned adjacent to respective rebar clips 26. Each rebar clip 26 receives one of the rods 36 so that the trench drains 10 are attached thereto. The trench drain 10 is held in place by frictional engagement of the rebar clip engagement surfaces 32 with the outer surfaces of the respective rod 36. The bottom of the trench drain 10 is positioned a distance "Y" above the bottom of the trench 70. This distance "Y" can easily be adjusted by forcing the clips 26 up or down the rod 36. Adjacent ends 16 and 18 are received by respective trench drains 10 such as shown in FIG. 5A. In this manner, screw holes 56 of the adjacent trench drains 10 are coaxially aligned. The screws 58 pass through and threadably engage the adjacent supporting ribs 24 so as to secure the adjacent trench drains 10 to each other. In this arrangement, the apex 65 of the crushing ribs 61 abut a face 80 of a support rib adjacent the female end 18. FIGS. 5A and 6A use primed numbers to indicate an adjacent trench drain 10' connected to trench drain 10.

The installer then breaks the frangible sections 55 and removes the spacer blocks 50 from the trench drain sidewalls 12. The installer then places the spacer blocks 50 onto the lips 22 as previously described so as to engage the spacer blocks 50 with the inner surfaces of the sidewalls 12. Specifically, edges of the spacer block ends 54 contact the lip surfaces 22*a* and 22*b*. Concrete "C" is then poured in the trench 70 in a space defined between the outer surfaces 73 of the trench drains 10 so as to embed the trench drain 10 in concrete. The pressure of the wet concrete forces the sidewalls 12 to deflect toward each other. This causes the spacer block ends 54 to abut against and coact with the inner surfaces of the lips 22, thereby preventing the sidewalls 12 from continuing to deflect toward each other. This results in substantially uniformly spaced apart sidewalls 12 from trench drain to trench drain. Hence, the spacer blocks 50 solve the wall deflection problem with the prior art plastic or polymeric trench drains. After the concrete hardens or sets, the spacer blocks 50 are removed and discarded, thereby resulting in a trench drain system formed by a plurality of trench drains 10. Finally, a grate 74 can be removably received by the lips 22 and secured to the trenches through the cross members 51 received within recesses 52. The seepage lips 29 collect water that seeps between the upper surface of the lip/concrete interface. Holes can be drilled in the lip so as to fluidly communicate the seepage lip with the interior of the trench drain 10. Also, the angled seepage lip assists in securing the trench drain 10 into the concrete.

As previously discussed, buckling is a common problem that exists in present polymeric trench drains. The buckling occurs due to the high coefficient of expansion of the polymeric materials as compared to concrete and cast iron. The buckling problem is not noticeable when the trench drains are installed during the winter months in a cold climate (such as in temperature of 32° F.). Preferably, adjacent trench drains 10 abut each other when initially installed as shown in FIG. 5A. A gap "G", which is equal to the height of the crushing rib as measured from the apex 65 to the base 67, is defined between the adjacent support ribs 24 and 24'. However, as the temperature increases during the summer months (say to 90° F. or higher), the length "L" of the trench drains increases. The trench drains are prevented from expanding too much because they are embedded in concrete. This then causes the trench drains 10 to become subject to internal compressive forces and could normally cause the trench drains 10 to buckle, such as shown in FIG. 7. The crushing ribs 61 overcome this problem. The crushing ribs 61 have a wall thickness substantially less than the wall thickness of the remainder of the trench drain. Hence, when the trench drain begins to expand in the longitudinal direction due to an increase in temperature, the crush ribs 61 will crush and flatten the apex due to compressive forces between face 80 and the crush rib 61 as shown in FIGS. 6A and 6B relieving the compressive forces which can cause buckling. Hence, the crushing of the ribs 61 prevents buckling of the trench drain 10 due to these compressive forces. The gap "G" becomes smaller as the crushing rib 61 compresses and the distance between apex 65 and the base 67 becomes smaller. Although crushing ribs 61 are shown adjacent the male end 16 and not on the female end 18, the crushing ribs 61 could be positioned adjacent the female end 18 and not on the male end 16. Alternatively, the crushing ribs 61 can be positioned on both the female end and male end.

Figure 11:
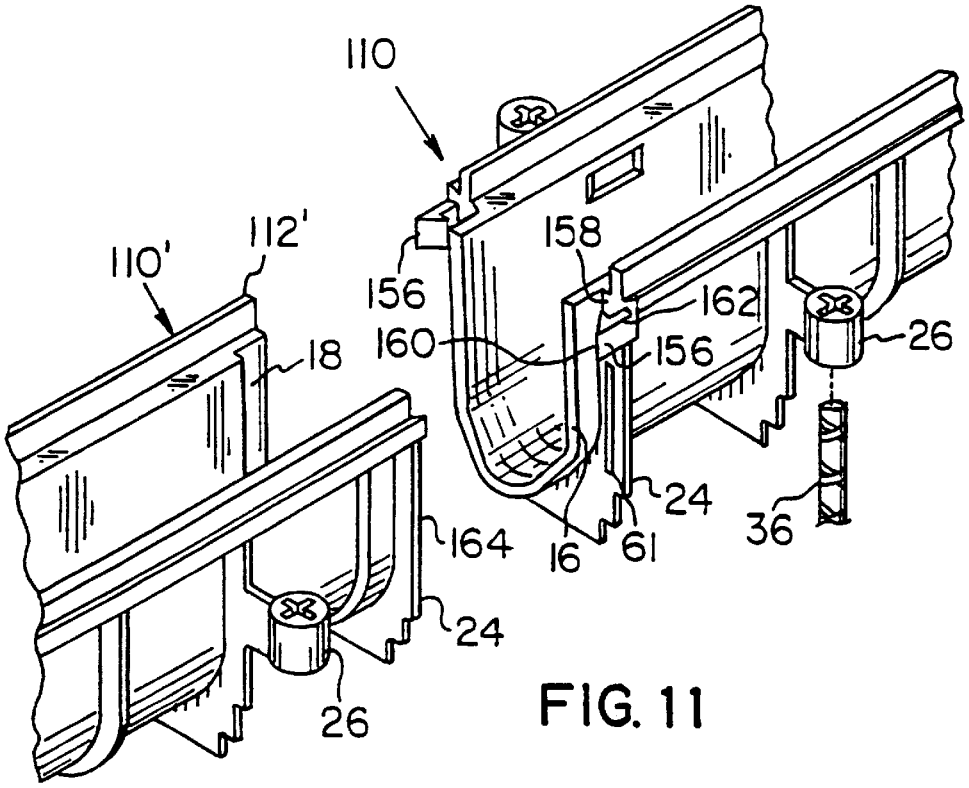
FIG. 11 is an exploded top perspective view of portions of two adjacent trench drains made in accordance with a second embodiment of the present invention.

FIG. 11 shows a second embodiment of a trench drain 110 made in accordance with the present invention. Trench drain 110 is similar to trench drain 10; and therefore, only the differences will be described and like reference numerals will be used to describe like parts. The trench drain 110 includes two spaced apart securement clips 156, in lieu of the screws 58 and screw holes 56 of trench drain 10. The securement clips 156 are positioned on opposite sides of the trench drain 110.

Each securement clip 156 is integrally attached to the support rib 24 adjacent the male end 16 of trench drain 110. Each securement clip 156 includes a recess 158 defined by an angled tip 160 and a flexing body 162. Engagement members on surfaces 164 are defined on the support rib 24 adjacent the female end 18 of the trench drain 110. Only one of the engagement surfaces 164 is shown in FIG. 11. The other engagement surface is positioned on the opposite side of the support rib 24 of trench drain 110' adjacent the sidewall 112'. Essentially, the engagement surfaces 164 are defined by a portion of the support rib 24. In operation, the male end 16 matingly engages with the female end 18 of adjacent trench drains 110 and 110' so that the angled tips 160 are urged outwardly by the engagement surfaces 164 during installation. Once the male end 16 abuts against an abutting surface, the engagement surfaces 164 are received within the recesses 158. This causes the securement clips 156 to move toward each other and lockingly engage the engagement surfaces 164 with the securement clips 156 so that the adjacent trench drains 110 and 110' are secured to each other. The adjacent trench drains 110 and 110' can be disengaged by urging the securement clips 156 away from each other so that the adjacent trench drains 110 and 110' can be pulled away from each other.

Figure 12:
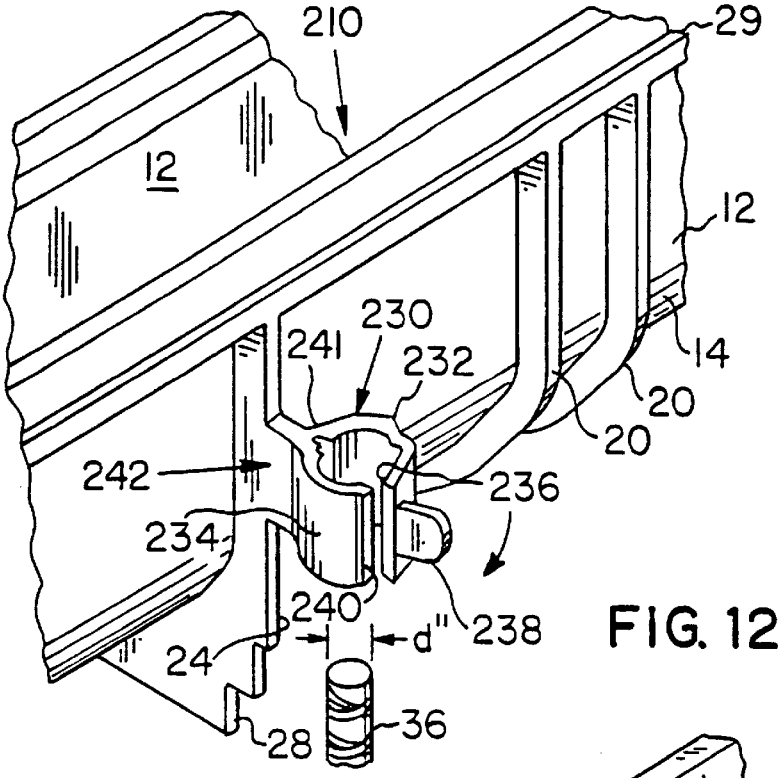
FIG. 12 is a top perspective view of a portion of a trench drain made in accordance with a third embodiment of the present invention, having a rebar clip in an open position.
Figure 13:
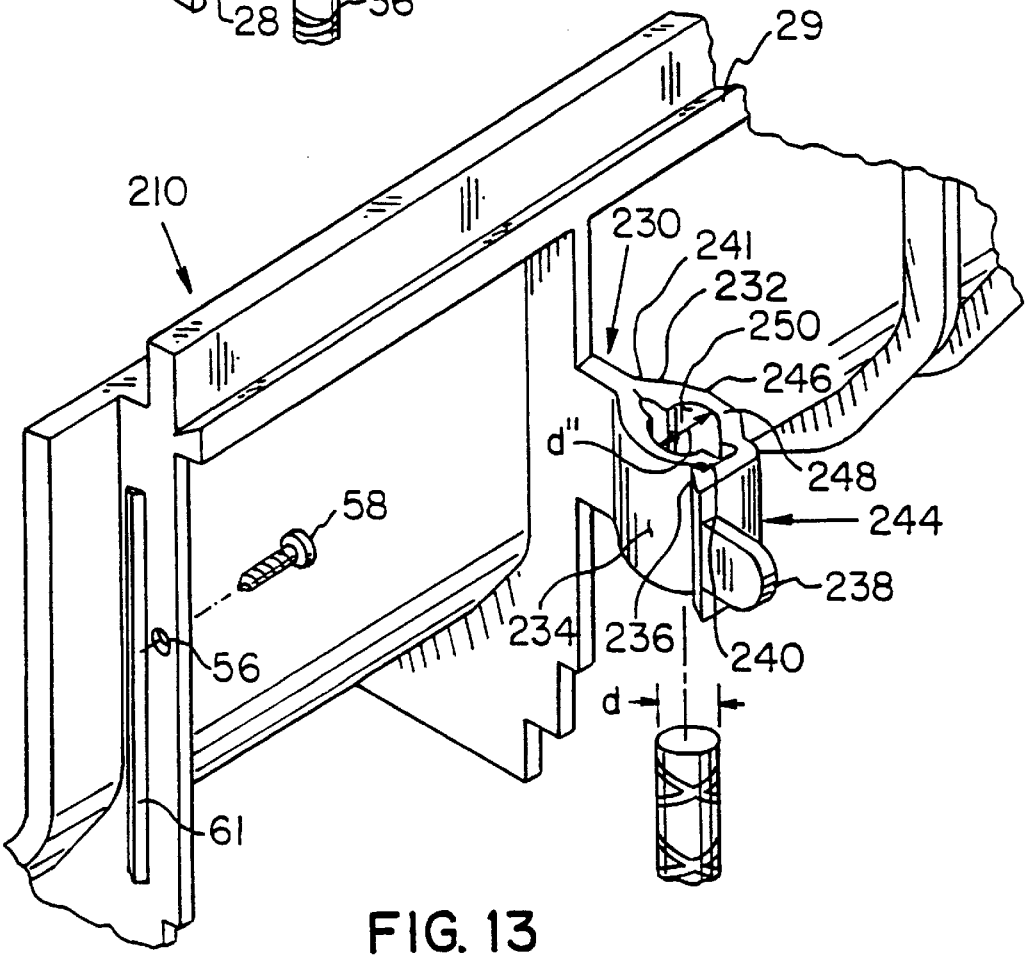
FIG. 13 is an exploded top perspective view of a portion of the trench drain shown in FIG. 12, where the rebar clip is in a closed position.

FIGS. 12 and 13 show a third embodiment of a trench drain 210. Trench drain 210 is similar to trench drain 10, except for the below noted differences. Like reference numerals will be used for like elements. Referring to FIG. 12, trench drain 210 includes two-piece rebar clips 230, in lieu of the unitary rebar clips 26. Only one of the rebar clips 230 is shown. Each rebar clip 230 is integrally formed on or secured to the support rib 24 of the trench drain 210. Each rebar clip 230 includes a first section 232 and a second section 234. An angled tip 236 is defined at an end of the first section 232 and an outwardly extending tab 238 is integrally formed on an outer portion of first section 232. An engagement surface 240 is defined on an end of the second section 234 and is adapted to engage with tip 236. A living hinge 241 secures the first section 232 to the support rib 24 so that said first section 232 can be moved relative to the second section 234.

FIG. 12 shows the rebar clip 230 in an unengaged position 242 so that the trench drain rebar clip 230 can slidably receive the rebar 36. The spacing between the first section 232 and second section 234 is such that the rebar clip 230 cannot hold the trench drain 210 to the rebar 36. FIG. 13 shows the rebar clip 230 in an engaged position 244, whereby the tip 236 abuts against the engagement surface 240 forming a closed structure. The tab 238 permits the installer to pull the tip 236 from the unengaged position 242 to the engaged position 244 after the rebar clip 230 is positioned on the rebar 36. The engaged rebar clip 230 includes a rebar clip body engagement surface 248, which defines a rebar clip hole 250 when the rebar clip 230 is in the engaged position 244. The diameter "d"" of the rebar clip hole 250 is less than the diameter "d" of the rebar 36. The rebar clip body engagement surface 248 frictionally engages with the outer surface of the rebar 36 when the rebar clip is in the engaged position. The position of the trench drain 210 on the rebar 36 can be adjusted by disengaging the rebar clip 230. This is accomplished by having the operator pull tab 238 so as to cause disengagement of the tip 236 from the engagement surface 240. Once the trench drain 210 is repositioned, the rebar clips 230 can be reengaged.

The rebar clips 26 and 230 replace the prior art arrangements for securing trench drains to rebar or other posts, namely the need for extra hardware. Likewise, securement clip 156 replaces the need of extra screws 58 to secure adjacent trenches and other arrangements of prior art trenches. The support ribs permit easy storage and stacking and transport of the trench drains. Further, the spacer blocks 50 prevent the trench drain walls from deforming during installation. Hence, the above-described trench drains 10, 110 and 210 overcome many of the problems of prior art trench drains.

Figure 14:
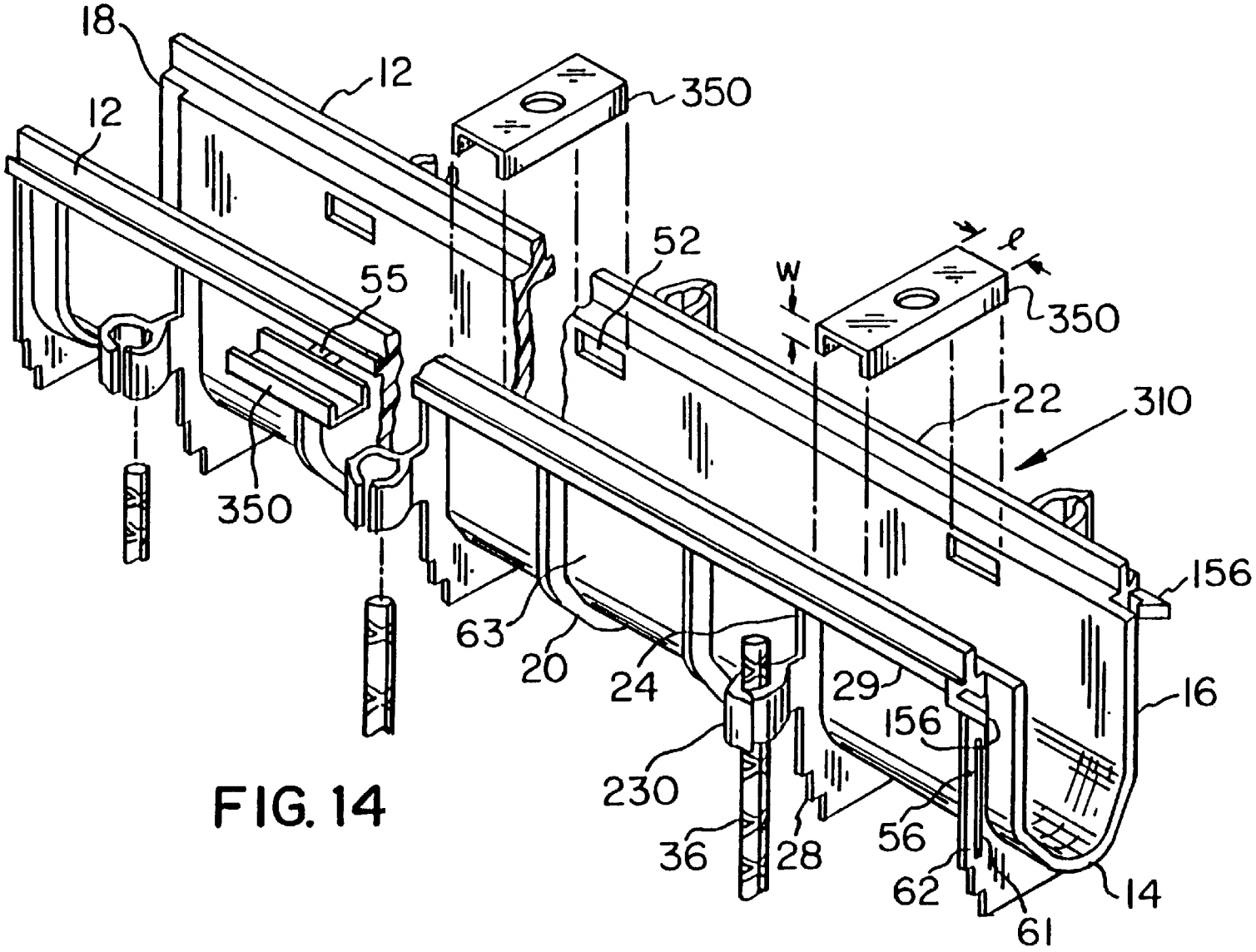
FIG. 14 is a top perspective view of a fourth embodiment of a trench drain made in accordance with the present invention.
Figure 15:
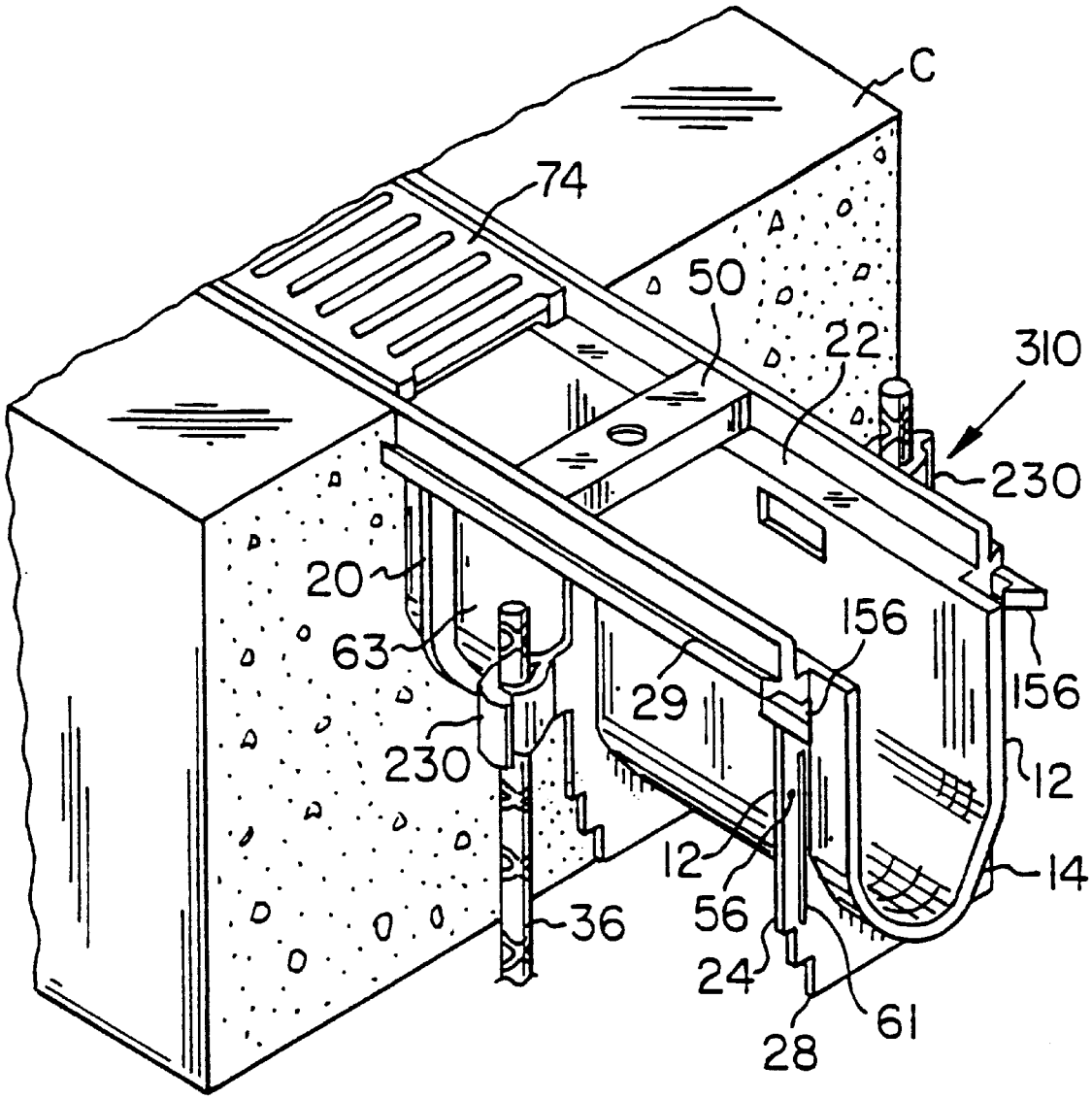
FIG. 15 is a top perspective view of the trench drain shown in FIG. 14 that is partially installed.

FIGS. 14 and 15 show a fourth embodiment of a trench drain 310 made in accordance with the present invention, which includes many of the features previously discussed. Like references will be used for like elements. Trench drains 310 include a securement clip 156 and rebar clips 230. Spacer blocks 350 are provided that are similar to spacer blocks 50. Spacer blocks 350 are U-shaped and include a base portion and two legs and are secured to the sidewalls 12 by frangible sections 55. Each end 354 has a length "l" and width "w", such that spacer blocks 350 can be removably received by lips 22, in the same manner as spacer blocks 50.

Figure 17:
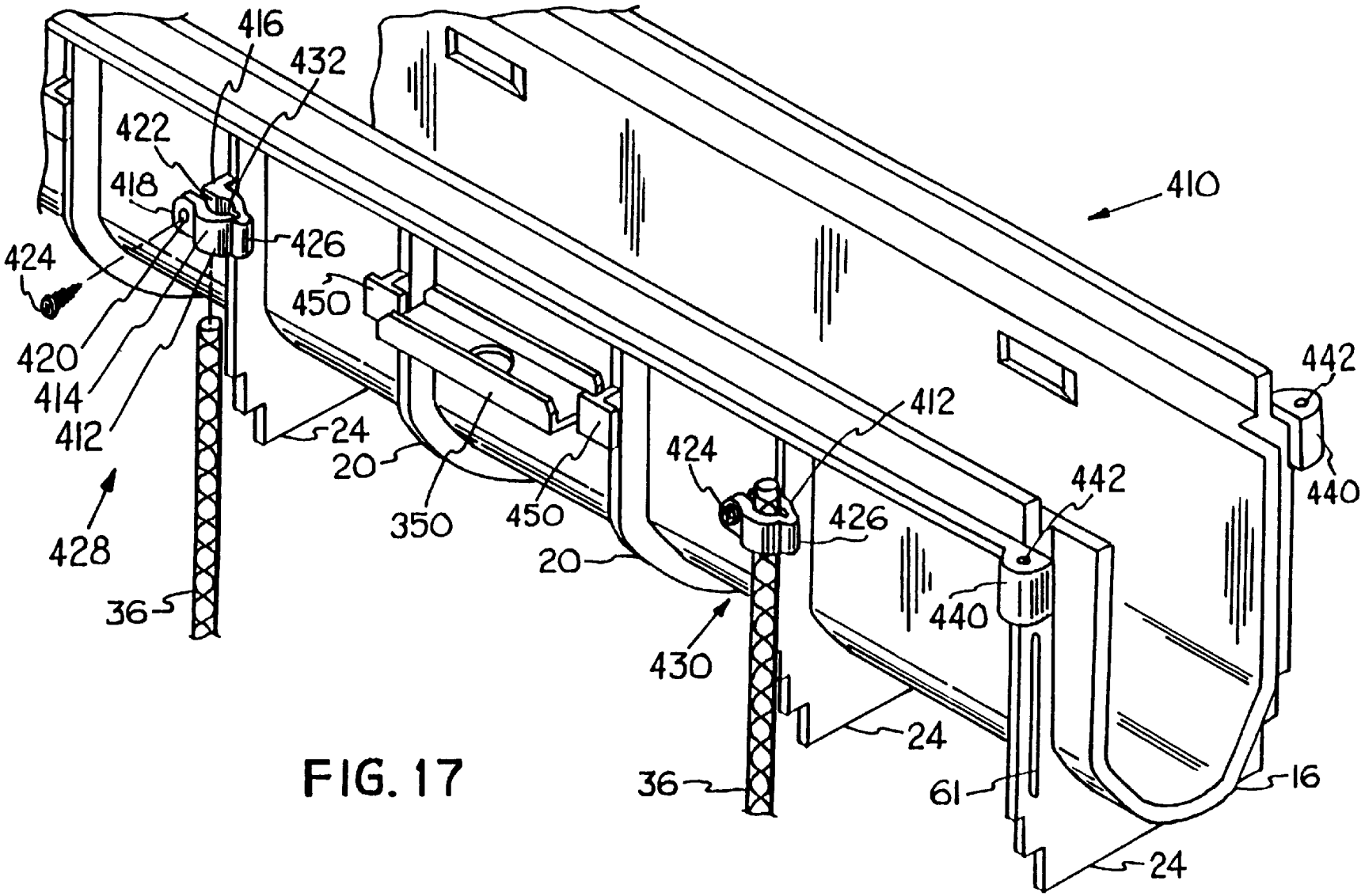
FIG. 17 is a partially exploded top perspective view of a portion of the trench drain shown in FIG. 16A having rebars secured thereto.
Figure 18:
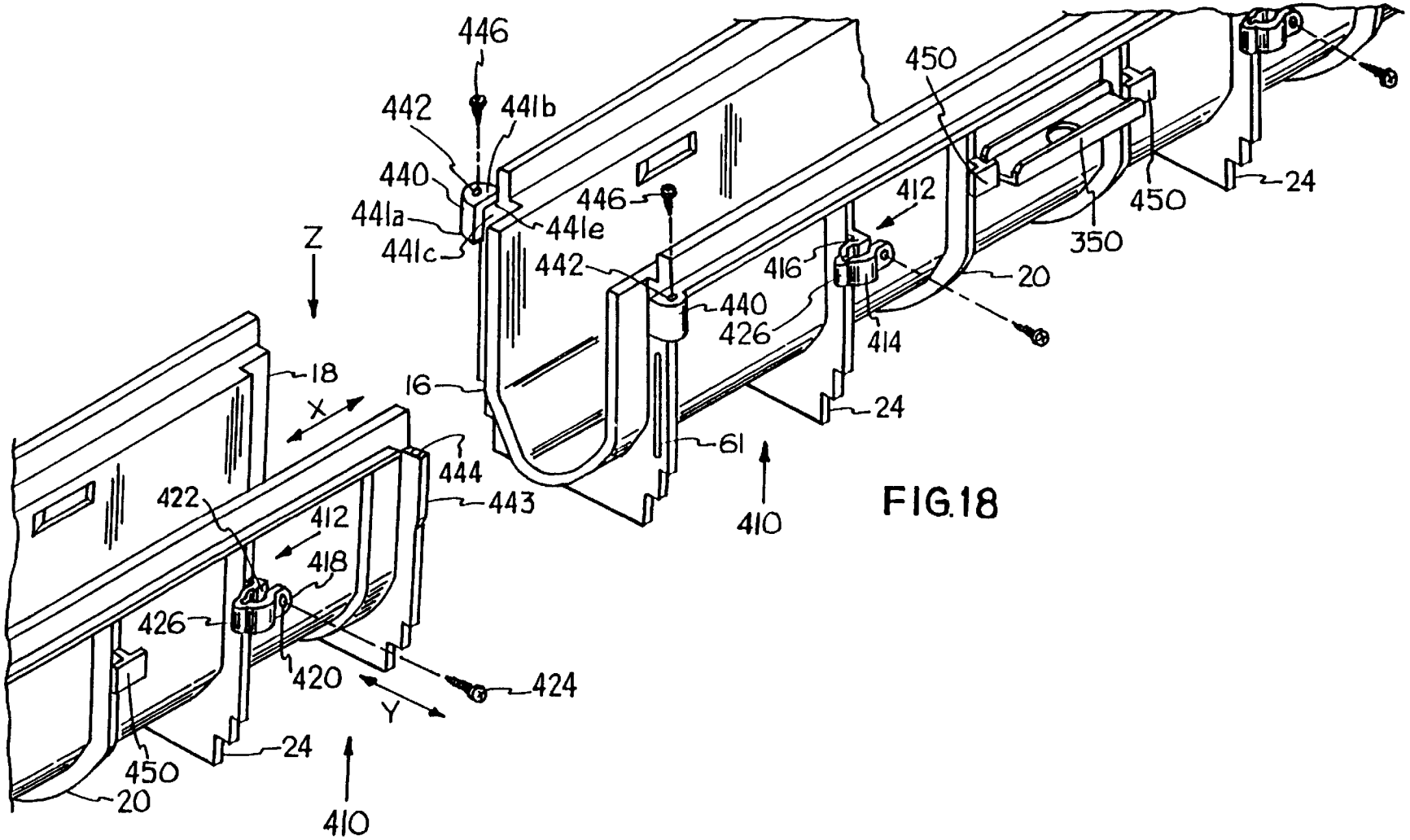
FIG. 18 is an exploded top perspective portion of two adjacent trench drains made in accordance to the trench drain shown in FIG. 16A.

FIGS. 16A–21 show a fifth embodiment of a trench drain 410 made in accordance with the present invention. Trench drain 410 is similar to trench drain 10 except for the below noted differences. Like reference numerals will be used for like elements. Referring to FIGS. 16A and 17–20, trench drain 410 includes two-piece rebar clips 412 in lieu of the unitary rebar clips 26. Rebar clips 412 are attached to an outer surface of the trench drain channel sidewalls. Referring to FIGS. 17 and 18, each rebar clip 412 is integrally formed on or secured to a support rib 24 of trench drain 410. Each rebar clip 412 includes a first section 414 and a second section 416. Tip 418 is defined at an end of the first section 414 having a screw receiving portion that defines screw hole 420. A screw engaging surface 422 is defined on an end of the second section 416 and is adapted to receive a screw 424. A living hinge 426 secures an end of the first section 414 to the second section 416 so that the tip 418 of the first section 414 can be aligned relative to the screw engaging surface 422 of the second section 416. In this arrangement, the first section 414 can move relative to the second section 416. An end of the second section 416 is secured to rib 24.

FIG. 17 shows the rebar clip 412 in an unengaged position 428 so that the rebar clip 412 can slidably receive the rebar 36. The spacing between the first section 414 and the second section 416 is such that the rebar clip 412 cannot hold the trench drain 410 to the rebar 36. FIG. 17 also shows the rebar clip 412 in an engaged position 430, whereby the tip 418 is aligned with the screw engaging surface 422. When screw 424 is inserted through screw hole 420 and is screwed into the screw engaging surface 422, a closed structure around the rebar is formed. The rebar clip 412 includes a rebar clip internal body engagement surface 432, which defines a rebar clip hole when the rebar clip 412 is in the engaged position 430. The rebar clip internal body engagement surface 432 frictionally engages with the outer surface of the rebar 36 when the rebar clip 412 is in the engaged position 430. The position of the trench drain 410 on the rebar 36 can be adjusted by loosening or removing the screw 424, thereby disengaging the rebar clip 412, and then tightening the screw when the trench drain is appropriately positioned.

Figure 21:
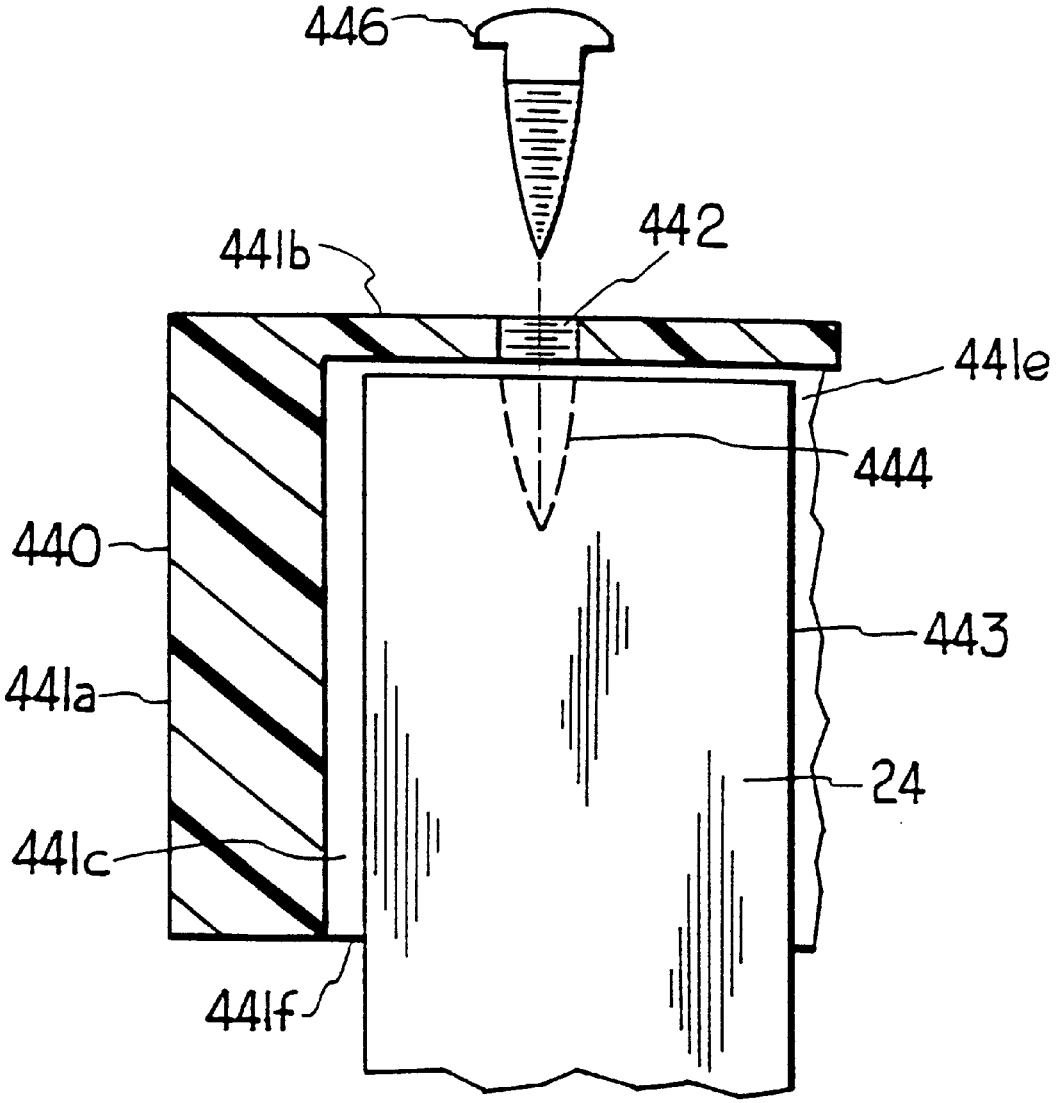
FIG. 21 is a partially exploded sectional elevational view of two adjacent trench drains.

As shown in FIGS. 18 and 21, trench drain 410 also includes two overlap connection members 440 integrally formed on or secured to the support rib 24 adjacent the male end 16. Each connection member 440 includes an arcuate sidewall 441*a* and an upper wall 441*b*. As shown in FIG. 21, a recess 441*c* is defined by sidewall 441*a* and upper wall 441*b*. A side opening 441*e* is defined by walls 441*a* and 441*b* and a bottom opening 441*f* is defined by wall 441*a*. The overlap connection members 440 have a screw hole 442 defined in wall 441*b*. Overlap connection members 440 are formed to overlap a portion 443 of the laterally extending support rib 24', defined on the female end 18 of the adjacent section of the trench drain 410. By laterally extending, it is meant that the ribs extend along a Y axis that is normal to an X axis which the trench drain channel extends, as shown in FIG. 18. Specifically, each portion 443 of support rib 24' is received within recess 441*c*. Support rib 24', adjacent the female end 18, includes two oppositely positioned pilot screw holes 444 (of which only one is shown) that are positioned on upper surfaces of support rib 24' and configured to be aligned with the screw holes 442 of the connection members 440 when the portions 443 are received within respective recesses 441*c*. (Alternatively, overlap connection members 440 can be provided on the female end 18 and portions 443 can be provided on the male end 16.) Assembly of the male end 16 and the female end 18 of two individual sections of trench drain 410 requires that overlap connection members 440 be placed over the support rib 24' adjacent the female end 18 so that portions 443 (which form engagement members for overlap connection members 440) are received in recesses 441*c* and the screws 446 pass through respective screw holes 442 and 444 to secure the two adjacent trench drains. The overlap connection members 440 and portions 443 permit easy alignment of adjacent trench drains 410. Furthermore, easy installation of adjacent trench drains 410 can be accomplished because the connection members 440 are engaged by placing the overlap connection members 440 above portions 443 and then lower overlap connection members 440 in the "Z" direction until they engage with portions 443. The screws 446 can then be tightened by an installer who is positioned above the trench drains 410. This can be substantially easier than moving adjacent drains sideways to engage securement clip 156 or screws 58 when there is little room to maneuver in the trenches.

Figure 19:
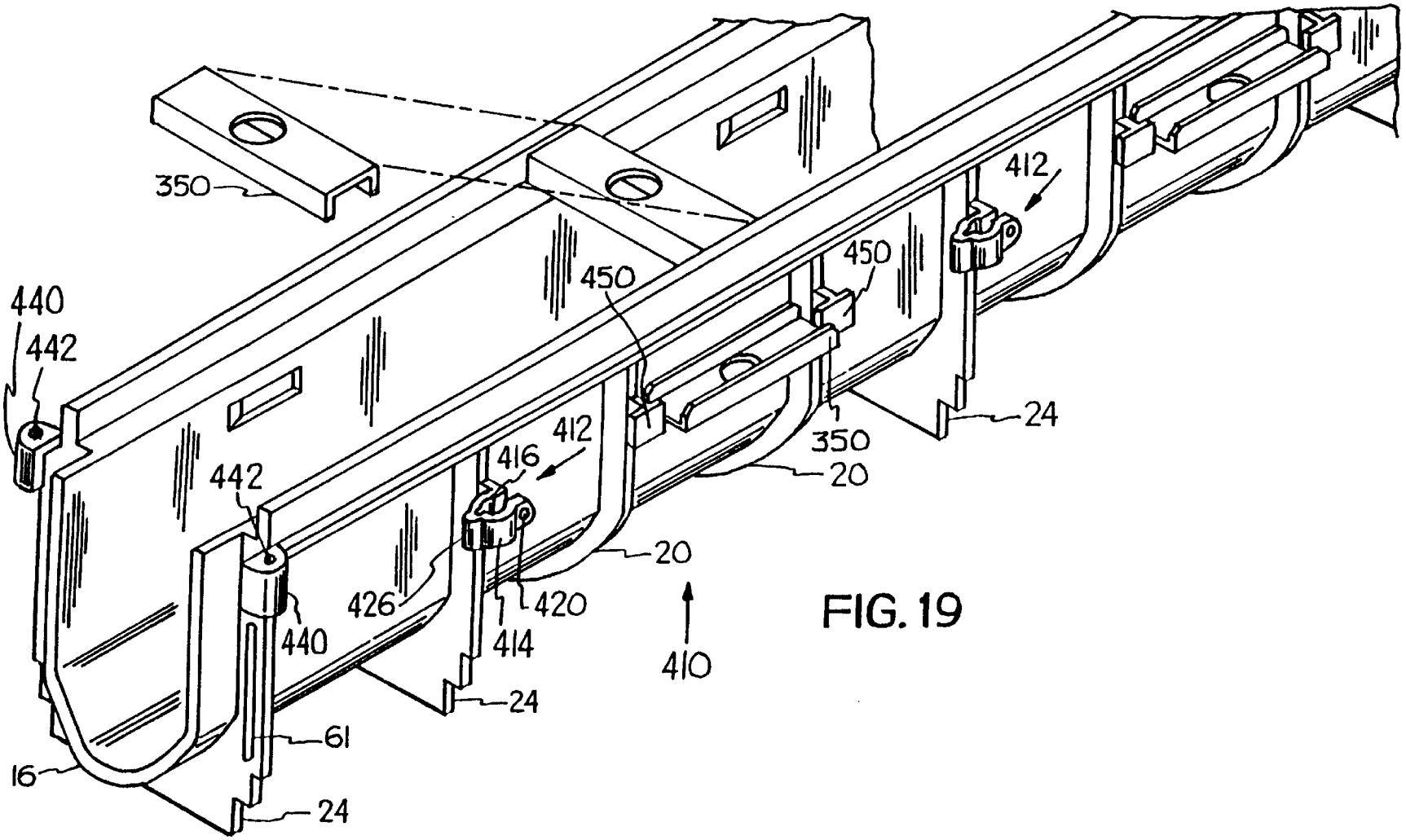
FIG. 19 is an exploded top perspective view of a portion of the trench drain shown in FIG. 16A.
Figure 20:
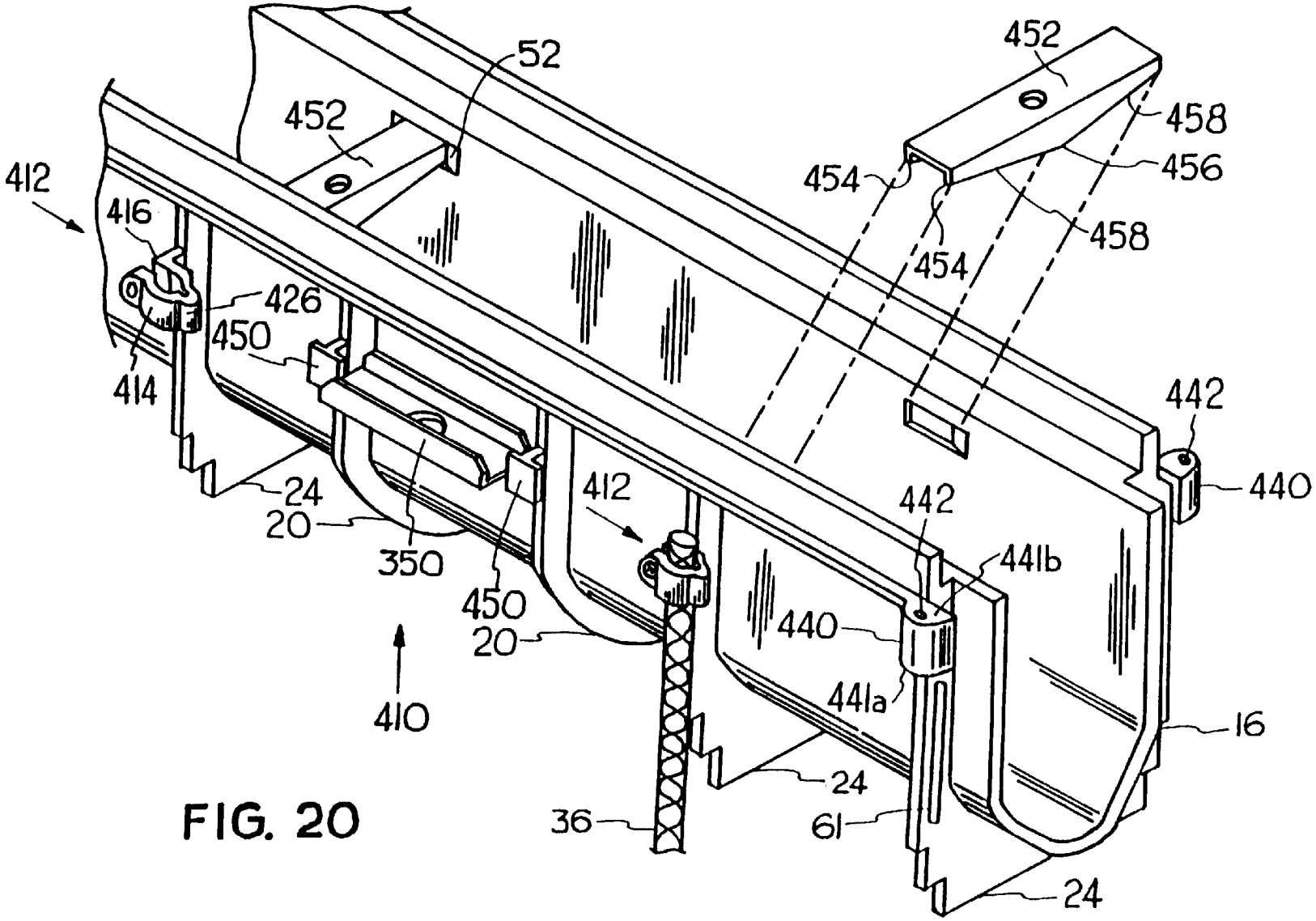
FIG. 20 is a partially exploded top perspective view of a portion of the trench drain shown in FIG. 16A with an engaged cross member.

As shown in FIG. 19, trench drain 410 also includes spacer blocks 350 having ends secured to ribs 20 by two frangible sections 450, as opposed to a single frangible section 55 as shown in FIG. 14. FIG. 20 shows cross members 452, which are similar to cross members 51 as shown in FIG. 10, having two legs 454 extending downward from a central portion forming a U-shape. Each leg 454 is wider at its middle 456 than at its ends 458. Cross member 452 is received in recesses 52. Each cross member 452 has a threaded hole defined in the central portion adapted to threadably receive a threaded fastener 453 that secures the grate 74 to the cross member 452.

FIGS. 16B and 16C show a closed end 460 and an outlet end 462 each being configured to be attached to either the male end 16 or the female end 18 of the trench drain 410. FIG. 16D shows an outlet attachment 470 having an upper section 472 and a lower section 474. The lower section 474 is in the form of a tube which can be inserted over a cutout (not shown) in the bottom wall 14 of the trench drain 410. The upper section 472 is shaped to form fit outside the trench drain 410 to aid in sealing the cutout (not shown). Although crushing ribs 61 are shown, the trench drain 410 can be manufactured without the crushing ribs 61.

Finally, it is preferable that the crushing ribs, securement clips, rebar clips and spacer blocks be integrally formed with the trench drain channel 15 in one molding process. However, it is possible to attach the clips and spacer blocks to the channel 15 after it is formed or molded. The various features of each embodiment can also be combined with other embodiments or substituted therefor.

Having described the presently preferred embodiments of our invention, it is to be understood that it may otherwise be embodied within the scope of the appended claims.

We claim:

1. A trench drain comprising:

an open-faced channel having spaced apart sidewalls connected to a bottom wall, said channel having a first end and a second end; and a clip integrally formed on an outer surface of one of said sidewalls, said clip having a two-piece body defined by a first section and a second section, said first section including a tip defining a screw hole and said second section including a fastener engaging surface, said first section hinged to an end of said second section, and said second section secured to said channel, said first section adapted to move relative to said second section so that said screw hole can align with said fastener engaging surface for a screw to pass through said tip and said fastener engaging surface to form a closed structure defining a support rod engagement surface for engaging with a support rod to support said channel.

2. A trench drain as claimed in claim 1, further comprising a crushing section defined in said channel, said crushing section adapted to crush when a compressive force is applied to the channel in a longitudinal direction so as to prevent buckling of said channel due to the compressive force.

3. A trench drain as claimed in claim 1, wherein said first end includes a male section and said second end includes a female section, said female section adapted to matingly receive a respective male section of an adjacent trench drain.

4. A trench drain as claimed in claim 1, further comprising means for securing two adjacent trench drains together.

5. A trench drain as claimed in claim 4, wherein said means for securing two adjacent trench drains together comprises a connection member having a body portion adapted to overlap a portion of an adjacent trench drain.

6. A trench drain as claimed in claim 5, wherein said connection member body defines a recess adapted to receive therein an engagement member of an adjacent trench drain in said recess.

7. A trench drain as claimed in claim 6, wherein said engagement member is a rib extending from said channel adjacent to said female section.

8. A trench drain as claimed in claim 6, further comprising fasteners for securing said connection member to the engagement member of an adjacent trench drain.

9. A trench drain as claimed in claim 1, further comprising a plurality of ribs extending from said channel.

10. A trench drain as claimed in claim 9, further comprising a stacking profile defined by a lower portion of said ribs, said stacking profile adapted to matingly engage with a surface of another trench drain channel to permit stacking of said trench drain prior to installation.

11. A trench drain as claimed in claim 10, wherein said channel includes a lip extending from each of said sidewalls, said lips being spaced apart and adapted to receive a grate, said stacking profile including stepped portions adapted to matingly engage with surfaces of said lips.

12. A trench drain as claimed in claim 1, further comprising a spacer block secured to said channel.

13. A trench drain as claimed in claim 1, wherein said spacer block is secured to said channel by a frangible section, said spacer block is removed from said channel by breaking said frangible section and is adapted to coact with inner surfaces of said sidewalls to prevent said sidewalls from moving toward each other.

14. A trench drain as claimed in claim 13, wherein said spacer block includes a base and two legs depending from said base.

15. A trench drain as claimed in claim 1, wherein said channel comprises a polymeric material.

16. A trench drain comprising:

an open-faced channel having spaced apart sidewalls connected to a bottom wall, said channel having a first end and a second end;

a connection member having a body that defines a recess adapted to receive therein an engagement member of an adjacent trench drain in said recess, said connection member secured to said channel;

wherein said channel extends along a longitudinal axis and said connection member body comprises a sidewall and an upper wall that define the connection member recess, said connection member body defining a side opening and a bottom opening for receipt of the engagement member defined by a portion of a laterally extending rib of the adjacent trench drain into the recess; and an engagement member secured to said channel adapted to be received by a connection member of an adjacent trench drain, wherein said engagement member is a rib extending from said channel.

17. A trench drain as claimed in claim 16, further comprising fasteners for securing said connection member to the engagement member of an adjacent trench drain.

18. A trench drain as claimed in claim 17, wherein said fasteners are received by an upper surface of said engagement member.

* * * * *

UNITED STATES PATENT AND TRADEMARK OFFICE

CERTIFICATE OF CORRECTION

PATENT NO. : 5,971,662

DATED : October 26, 1999

INVENTOR(S) : Allen R. Becker et al.

It is certified that error appears in the above-identified patent and that said Letters Patent is hereby corrected as shown below:

Column 1 Lines 43-44 "5,066," and "165" should read --5,066,165 --.

Column 4 Lines 52-53 "angle a" should read --angle α--.

Signed and Sealed this

Sixteenth Day of May, 2000

*Attest:*

*Attesting Officer*

Q. TODD DICKINSON

*Director of Patents and Trademarks*